US010323615B2

(12) United States Patent
Laity et al.

(10) Patent No.: US 10,323,615 B2
(45) Date of Patent: Jun. 18, 2019

(54) FUEL PUMP APPARATUS

(71) Applicant: DELPHI TECHNOLOGIES IP LIMITED, St. Michael (BB)

(72) Inventors: Kevin Laity, Gillingham (GB); Ian Thornthwaite, Gillingham (GB); James Thompson, Gillingham (GB)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 15/574,850

(22) PCT Filed: May 20, 2016

(86) PCT No.: PCT/EP2016/061380

§ 371 (c)(1),
(2) Date: Nov. 17, 2017

(87) PCT Pub. No.: WO2016/185006

PCT Pub. Date: Nov. 24, 2016

(65) Prior Publication Data

US 2018/0128227 A1 May 10, 2018

(30) Foreign Application Priority Data

May 20, 2015 (GB) ..... 1508608.5

(51) Int. Cl.

| | |
|---|---|
| ***F02M 59/44*** | (2006.01) |
| ***F04B 1/04*** | (2006.01) |
| ***F02M 59/48*** | (2006.01) |
| ***F04B 53/02*** | (2006.01) |
| ***F04B 53/16*** | (2006.01) |

(52) U.S. Cl.

CPC ..... *F02M 59/442* (2013.01); *F02M 59/48* (2013.01); *F04B 1/0448* (2013.01); *F04B 53/02* (2013.01); *F04B 53/162* (2013.01)

(58) Field of Classification Search

CPC ..... F02M 59/442; F02M 59/48; F04B 53/02; F04B 53/162; F04B 1/0448

See application file for complete search history.

(56) References Cited

U.S. PATENT DOCUMENTS 4,793,043 A * 12/1988 Mathews ..... B23P 6/00 29/402.06
7,451,741 B1 * 11/2008 Bartley ..... F02M 59/102 123/445
8,091,530 B2 * 1/2012 Surnilla ..... F02D 41/2464 123/446

(Continued)

FOREIGN PATENT DOCUMENTS

JP 2010127153 A 6/2010

*Primary Examiner* — Joseph J Dallo
(74) *Attorney, Agent, or Firm* — Joshua M. Haines

(57) ABSTRACT

A hydraulic head assembly includes a hydraulic head and an adaptor. The hydraulic head has a first bore and a pumping chamber. The adapter has a second bore. The adapter is connected to the hydraulic head such that the first and second bores are disposed coaxially to form a pumping element bore. A pumping element is disposed within the first and second bores for pressurizing fuel in the pumping chamber. A first seal is formed between the pumping element and the hydraulic head; and a second seal is formed between the pumping element and the adapter.

20 Claims, 7 Drawing Sheets

(56) References Cited

U.S. PATENT DOCUMENTS

| | | | | |
|---|---|---|---|---|
| 8,317,501 | B2 * | 11/2012 | Inoue | F04B 37/12 417/540 |
| 8,651,827 | B2 * | 2/2014 | Usui | F02M 59/366 123/455 |
| 8,668,465 | B2 * | 3/2014 | Wadsley | F04B 1/28 417/216 |
| 8,905,732 | B2 * | 12/2014 | Kuttler | F04B 7/0076 417/505 |
| 9,267,496 | B2 * | 2/2016 | Kawano | F02M 59/368 |
| 9,404,481 | B2 * | 8/2016 | Oikawa | F04B 1/0452 |
| 9,410,519 | B2 * | 8/2016 | Usui | F02M 39/02 |
| 9,845,778 | B2 * | 12/2017 | Mitsuoka | B60W 10/06 |
| 2006/0201485 | A1 | 9/2006 | Usui et al. | |
| 2006/0239846 | A1 | 10/2006 | Oda et al. | |
| 2008/0302333 | A1 | 12/2008 | Usui et al. | |
| 2012/0195778 | A1 | 8/2012 | Koga et al. | |
| 2012/0195780 | A1 | 8/2012 | Matsumoto et al. | |
| 2016/0377042 | A1 | 12/2016 | McCrindle | |

* cited by examiner

FUEL PUMP APPARATUS

CROSS REFERENCE TO RELATED APPLICATIONS

This application is a national stage application under 35 USC 371 of PCT Application No. PCT/EP2016/061380 having an international filing date of May 20, 2016, which is designated in the United States and which claimed the benefit of GB Patent Application No. 1508608.5 filed on May 20, 2015, the entire disclosures of each are hereby incorporated by reference in their entirety.

TECHNICAL FIELD

The present disclosure relates to fuel pump apparatus. More particularly, but not exclusively, the present disclosure relates to a hydraulic head assembly; to a pump comprising a hydraulic head assembly; and to an adapter for a hydraulic head assembly.

BACKGROUND

A known fuel-lubricated pump P1 adapted to supply fuel to a fuel injection system for an internal combustion engine is shown in FIG. 1. The fuel-lubricated pump P1 relies on the fuel being pumped as a lubricating medium. The fuel-lubricated pump P1 is configured to supply diesel fuel at high pressure to a common rail (not shown) connected to a plurality of fuel injectors. The fuel-lubricated pump P1 comprises a hydraulic head assembly 101 disposed in a pump housing H1. As shown in FIG. 2, the hydraulic head assembly 101 comprises a hydraulic head 102 having a body 103 and a turret 104. The turret 104 comprises a cylindrical projection formed integrally with the body 103. A first bore 105 and a pumping chamber 106 are formed in the hydraulic head 102. The first bore 105 has a longitudinal axis X and extends through the turret 104. The pumping chamber 106 has a larger diameter than the first bore 105. A pumping element 107 in the form of a plunger is disposed in said first bore 105 to pressurise fuel in the pumping chamber 106. The pumping element 107 cooperates with a rotating cam via a roller shoe assembly to cause the pumping element 107 to reciprocate within the first bore 105. An inlet valve 108 is provided for controlling the introduction of fuel into the pumping chamber 106. The inlet valve 108 comprises an inlet valve member 109 arranged to cooperate with an inlet valve seat 110. A first spring element 111 cooperates with the inlet valve member 109. An outlet valve 112 is provided for controlling the expulsion of fuel from the pumping chamber 106 to the common rail. The outlet valve 112 comprises an outlet valve member 113 arranged to cooperate with an outlet valve seat 114. A second spring element 115 is provided to bias the outlet valve member 113 into a seated position in said outlet valve seat 114, thereby closing the outlet valve 112. The outlet valve 112 is opened when the pressure of the fuel in the pumping chamber 106 overcomes the spring bias applied to the outlet valve member 113 by the second spring element 115 and the fuel pressure in the common rail. The first bore 105 and the pumping element 107 are sized to form a first seal 116. The first seal 116 is a high pressure seal and has a high pressure leakage control length L2 which is extended by the turret 104.

A limitation of the fuel-lubricated pump P1 is a potential lack of robustness to poor lubricity fuels, for example due to different grades of fuel available in different territories. A further potential limitation is in the length of the high pressure leakage control length L2 due to the need accurately to machine the inlet valve seat 110 over the length L1.

It is known to provide a fuel pump with a lubricating medium, typically oil, which is maintained separate from the fuel. A known oil-lubricated pump P2 is shown in FIG. 3. The oil-lubricated pump P2 is configured to supply diesel fuel at high pressure to a common rail (not shown) connected to a plurality of fuel injectors. The oil-lubricated pump P2 comprises a hydraulic head assembly 201 disposed in a pump housing H2. As shown in FIG. 4, the hydraulic head assembly 201 comprises a hydraulic head 202 having a body 203 and a turret 204. A first bore 205 and a pumping chamber 206 are formed in the hydraulic head 202. The pumping chamber 206 has a larger diameter than the first bore 205. A pumping element 207 in the form of a plunger is disposed in said first bore 205 to pressurise fuel in the pumping chamber 206. The pumping element 207 cooperates with a rotating cam via a roller shoe assembly (not shown) to cause the pumping element 207 to reciprocate within the first bore 205. An inlet valve 208 is provided for controlling the introduction of fuel into the pumping chamber 206. The inlet valve 208 comprises an inlet valve member (not shown) arranged to cooperate with an inlet valve seat 210. An outlet valve 212 is provided for controlling the expulsion of fuel from the pumping chamber 206 to the common rail. The outlet valve 212 comprises an outlet valve member 213 arranged to cooperate with an outlet valve seat 214. The first bore 205 and the pumping element 207 are sized to form a first seal 216 and a second seal 217. The first seal 216 is a high pressure seal and has a high pressure leakage control length L2. The second seal 217 is a low pressure seal and has a low pressure leakage control length L3. A third seal 218 in the form of a polytetrafluoroethylene (PTFE) lip seal is disposed below the second seal 217. An annular chamber 219 and a return line 220 are formed in the hydraulic head 202 between the first and second seals 216, 217. The second seal 217 functions as a back-up seal for the third seal 218. The oil-lubricated pump P2 can be assembled to form a direct unit pump (DUP) which is located directly into an engine block. The hydraulic head assembly 201 can also be disposed in a cam box to form an oil lubricated pump, as shown in FIG. 3.

The high pressure leakage control length L2 of the first seal 216 must be sufficient to maintain pumping efficiency; and the low pressure leakage control length L3 must be of sufficient length to inhibit mixing of oil into the fuel. However, the need accurately to machine the inlet valve seat 210 restricts the high and low pressure leakage control lengths L2, L3 of the first and second seals 216, 217.

The oil-lubricated pump P2 provides improved robustness to different grades of fuel. Nonetheless, production volumes of oil-lubricated pumps are expected to remain relatively low. The lower production volumes reduce the economies of scale for production of the oil-lubricated pump P2. This is particularly problematic in view of the need for a specific design of hydraulic head 202.

It is against this backdrop that the present invention has been conceived. At least in certain embodiments, the present invention seeks to overcome or ameliorate at least some of the problems associated with known fuel pumps.

SUMMARY OF THE INVENTION

Aspects of the present invention relate to a hydraulic head assembly. More particularly, but not exclusively, the present invention relates to a hydraulic head assembly having an adapter; to a pump comprising a hydraulic head assembly; and to an adapter for a hydraulic head assembly.

According to a further aspect of the present invention there is provided a hydraulic head assembly comprising:

- a hydraulic head having a first bore and a pumping chamber;
- an adapter having a second bore, the adapter being connected to said hydraulic head such that said first and second bores form a substantially continuous pumping element bore; and
- a pumping element disposed within said pumping element bore for pressurising fuel in the pumping chamber;
- wherein a first seal is formed between the pumping element and the hydraulic head; and a second seal is formed between the pumping element and the adapter. The adapter enables the hydraulic head to be used with a separate lubricating medium, such as oil. The first seal is operative to reduce or inhibit leakage of fuel from the pumping chamber. The second seal is operative to reduce or inhibit leakage of the separate lubricating medium past the pumping element.

The hydraulic head can comprise a body and a turret. The first bore can extend through the turret and into the body. The turret can be a cylindrical projection from said body. The adapter can be connected to said turret.

The adapter can comprise a mounting section for mounting the adapter to the hydraulic head. The mounting section can comprise a collar for cooperating with the turret. The collar can be an interference fit with an external sidewall of the turret.

The first seal can be a high pressure seal. The second seal can be a low pressure seal.

The adapter can comprise a polymeric seal for cooperating with the pumping element. The polymeric seal can, for example, be a polytetrafluoroethylene (PTFE) seal.

A leakage path can be formed between the turret and the adapter. A collection chamber can be provided in communication with the leakage path.

The adapter can comprise a backleak bore. The backleak bore can extend transversely through the adapter.

According to a further aspect of the present invention there is provided a fuel pump comprising one or more hydraulic head assembly of the type described herein.

The fuel pump can comprise a plurality of said hydraulic head assemblies. The hydraulic head assemblies can be arranged in an in-line configuration. The fuel pump can, for example, comprise first and second hydraulic heads and adapters arranged in series.

According to a further aspect of the present invention there is provided an adapter for a hydraulic head assembly, the adapter comprising:

- a mounting section for mounting the adapter to a hydraulic head; and
- a sealing section having a first bore formed therein for receiving a pumping element, the sealing section being adapted to form at least one seal with said pumping element;
- wherein the adapter is configured such that, when mounted to the hydraulic head, the first bore aligns with a second bore formed in the hydraulic head to form a substantially continuous pumping element bore.

The sealing section can be adapted to form a low pressure seal with the pumping element.

The sealing section can comprise a polymeric seal for cooperating with the pumping element.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the present invention will now be described, by way of example only, with reference to the accompanying figures, in which.

DETAILED DESCRIPTION

Figure 5:
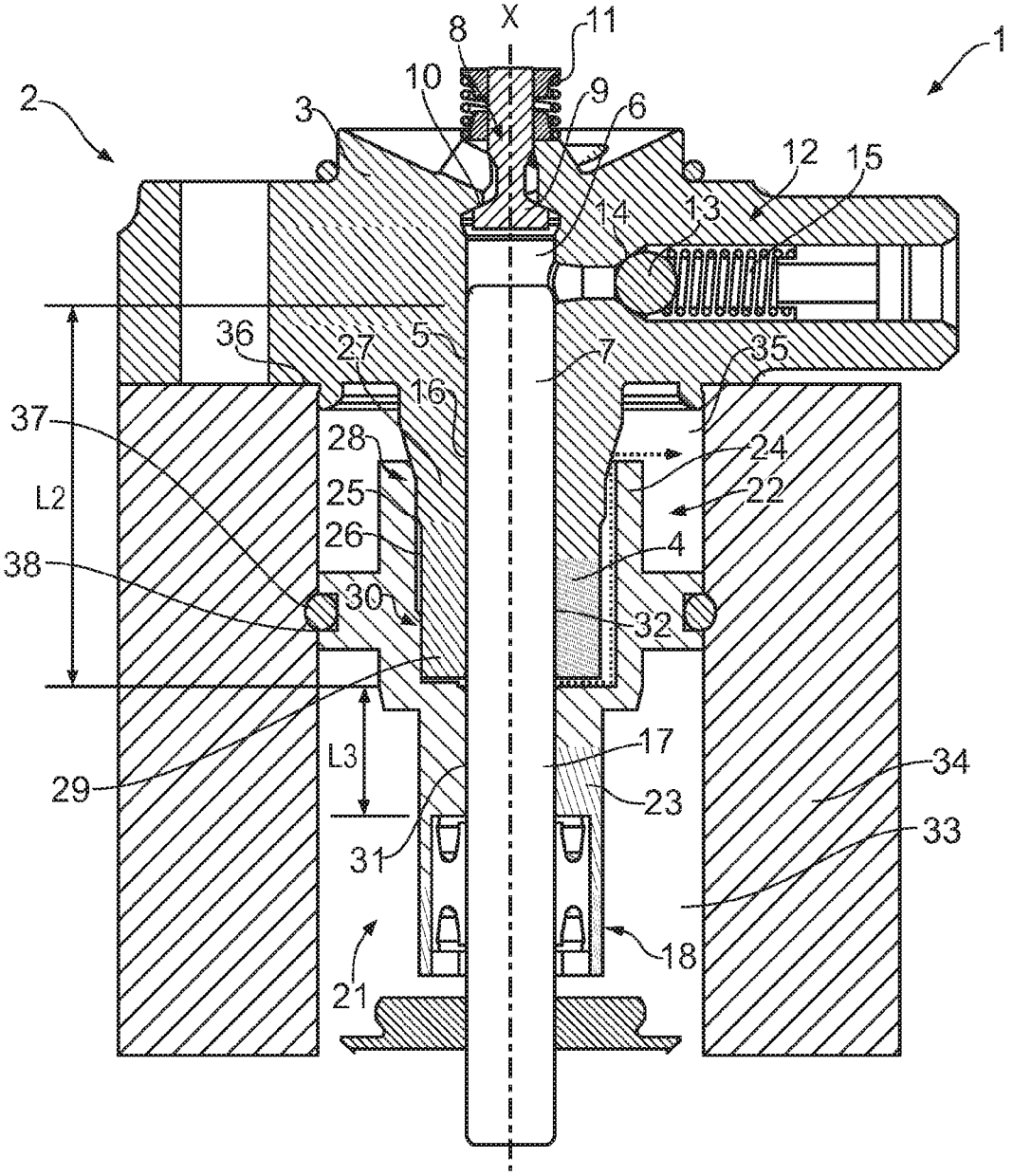
FIG. 5 shows a hydraulic head assembly comprising an adapter in accordance with an embodiment of the present invention.

A hydraulic head assembly 1 in accordance with an embodiment of the present invention will now be described with reference to FIG. 5. The hydraulic head assembly 1 is for use with an oil-lubricated pump P2 for supplying high pressure fuel to a fuel injection system (not shown). In particular, the hydraulic head assembly 1 is configured to be mounted to a pump housing H2 of the oil-lubricated pump P2. The oil-lubricated pump P2 is adapted to supply diesel fuel to a high pressure common rail connected to a plurality of fuel injectors for injecting fuel into a combustion chamber of an internal combustion engine.

Figure 1:
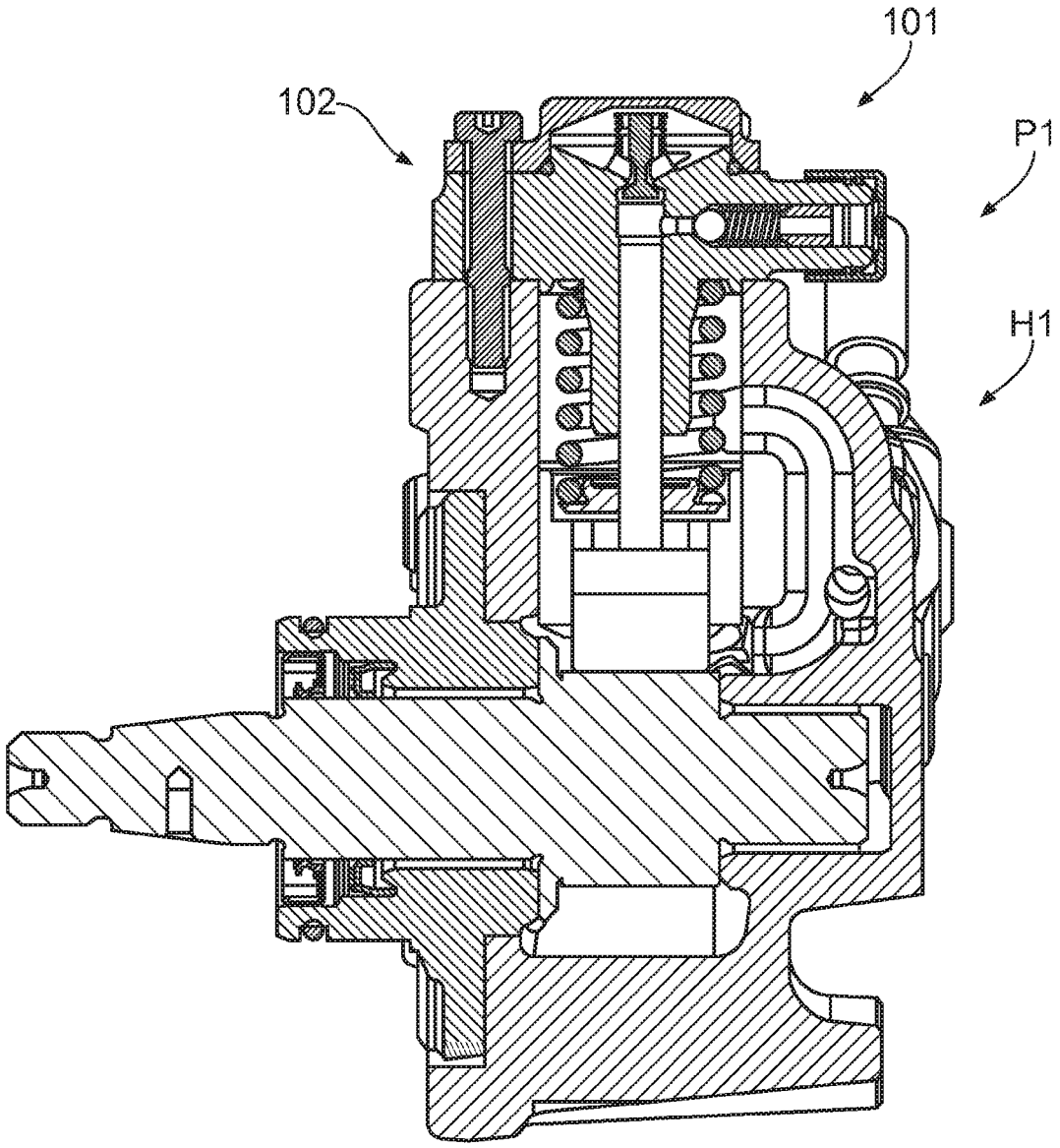
FIG. 1 shows a sectional view of a known fuel-lubricated pump for supplying high pressure fuel to a fuel injection system.
Figure 2:
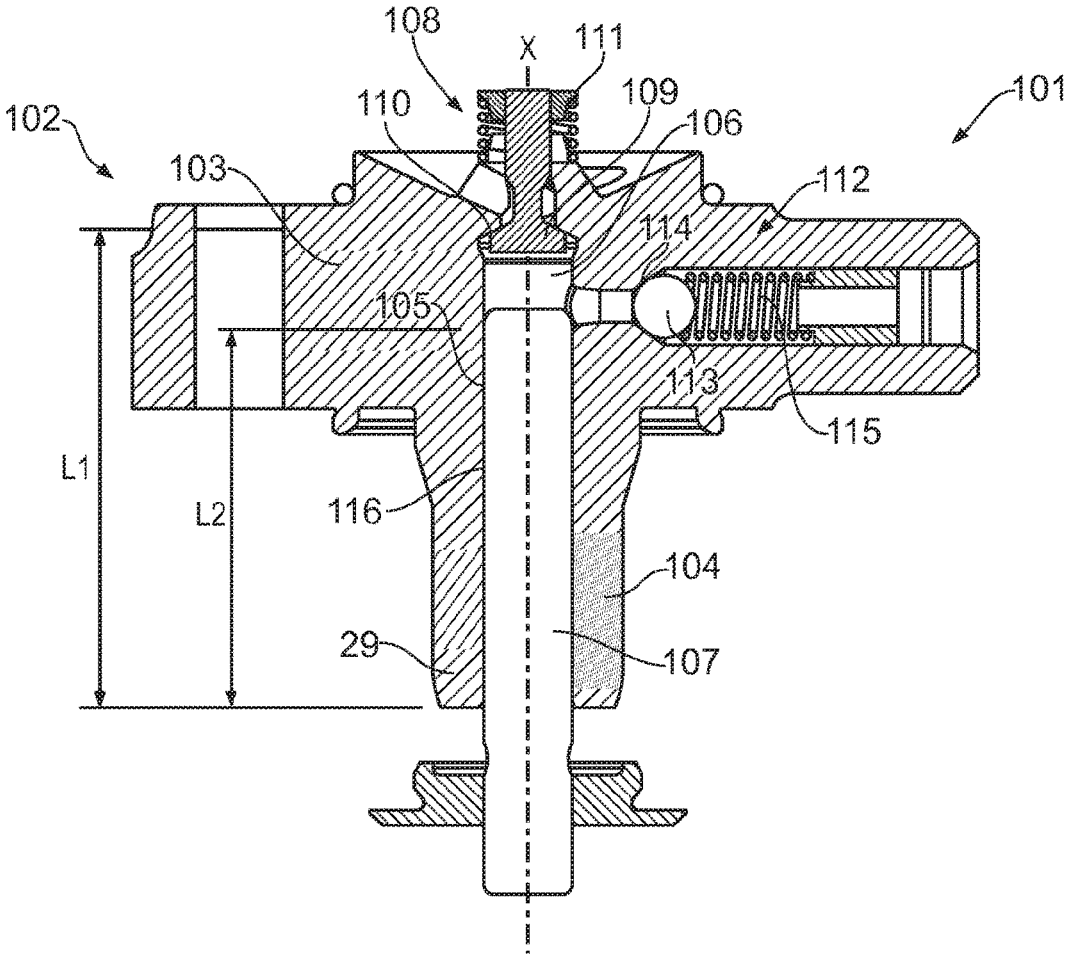
FIG. 2 shows a hydraulic head assembly of the fuel-lubricated pump shown in FIG. 1.

The hydraulic head assembly 1 comprises a hydraulic head 2 which is the same as the hydraulic head 102 of the fuel-lubricated pump P1 described herein with reference to FIGS. 1 and 2. The hydraulic head 2 comprises a body 3 and a turret 4. The turret 4 in the present embodiment comprises a cylindrical projection. A first bore 5 having a longitudinal axis X is formed in the hydraulic head 2. A pumping chamber 6 is also formed in the hydraulic head 2. The pumping chamber 6 is generally cylindrical and has a central axis arranged coaxially with the longitudinal axis X. The pumping chamber 6 has a larger diameter than the first bore 5. The first bore 5 extends through the turret 4 such that the longitudinal axis X of the first bore 5 is coincident with a central longitudinal axis of the turret 4. A pumping element 7 in the form of a plunger is disposed in said first bore 5 to pressurise fuel in the pumping chamber 6. The pumping element 7 cooperates with a rotating cam via a roller shoe assembly to cause the pumping element 7 to reciprocate along the longitudinal axis X of the first bore 5. An inlet valve 8 is provided for controlling the introduction of fuel into the pumping chamber 6. The inlet valve 8 comprises an inlet valve member 9 arranged to cooperate with an inlet valve seat 10. A first spring element 11 cooperates with the inlet valve member 9. An outlet valve 12 is provided for controlling the expulsion of fuel from the pumping chamber 6 to the common rail. The outlet valve 12 comprises an outlet valve member 13 arranged to cooperate with an outlet valve seat 14. A second spring element 15 is provided to bias the outlet valve member 13 into a seated position in said outlet valve seat 14, thereby closing the outlet valve 12. The outlet valve 12 is opened when the pressure of the fuel in the pumping chamber 6 overcomes the spring bias applied to the outlet valve member 13 by the second spring element 15 and the fuel pressure in the common rail. The first bore 5 and the pumping element 7 are sized to form a first seal 16. The first seal 16 is a high pressure seal and has a high pressure leakage control length L2, as shown in FIG. 5. The first seal 16 reduces or inhibits leakage of fuel from the pumping chamber 6.

Figure 3:
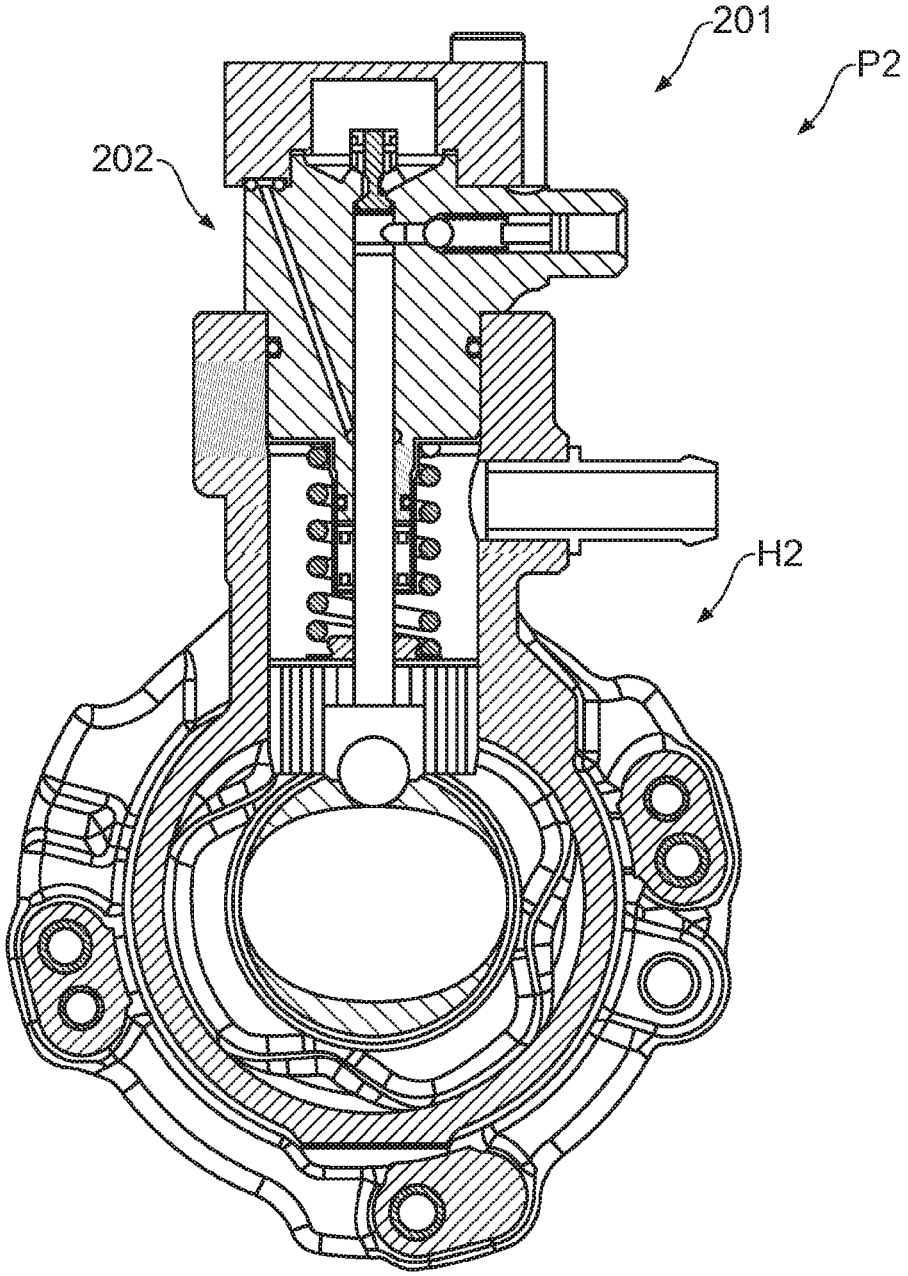
FIG. 3 shows a sectional view of a known oil-lubricated pump for supplying high pressure fuel to a fuel injection system.
Figure 4:
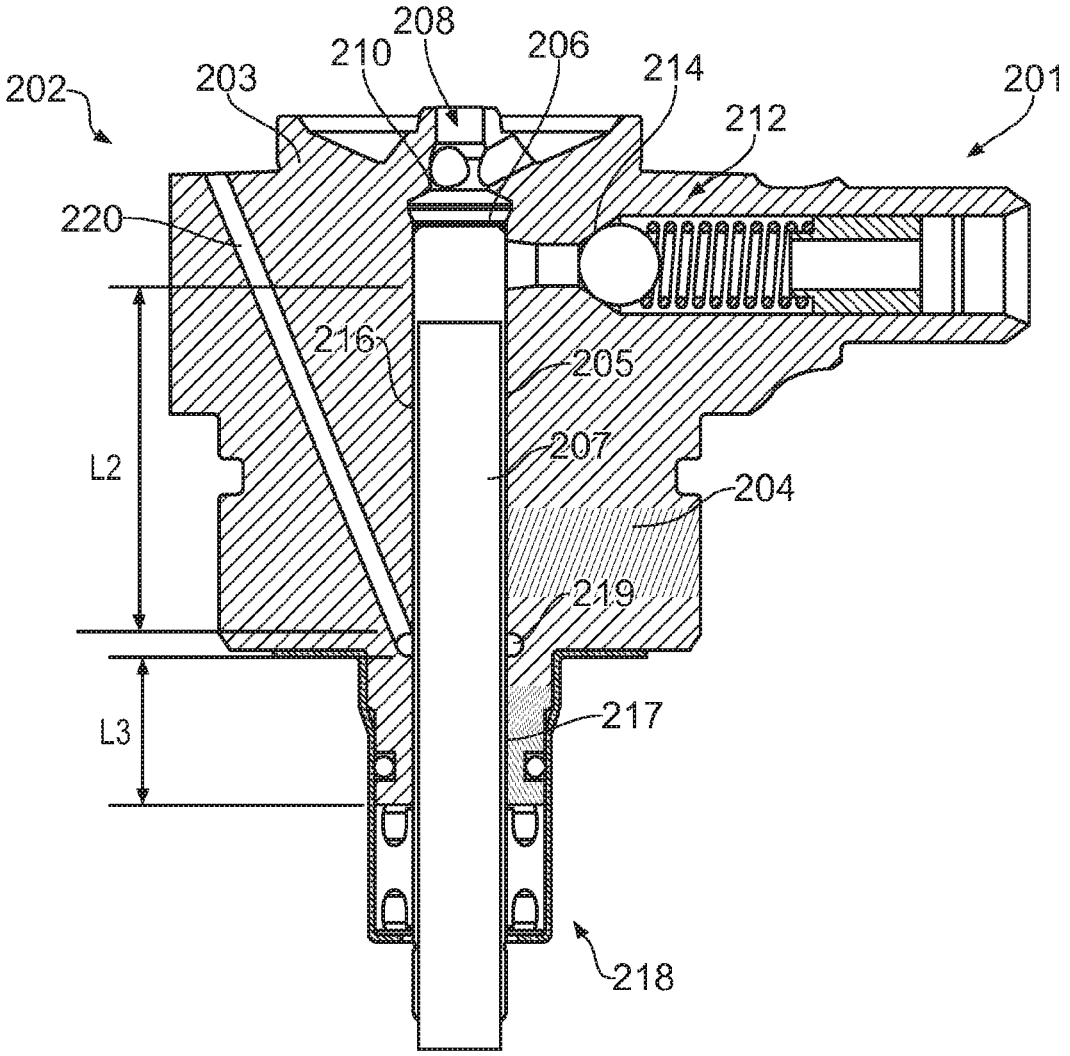
FIG. 4 shows a hydraulic head assembly of the oil-lubricated pump shown in FIG. 3.

The hydraulic head assembly 1 comprises an adapter 21 for adapting the hydraulic head 102 of a fuel-lubricated pump P1 (as described with reference to FIGS. 1 and 2) for use with an oil-lubricated pump P2 (as described with reference to FIGS. 3 and 4). The adapter 21 allows the hydraulic head 2 to be used with a separate supply of lubricating medium, such as oil. Accordingly, the adapter 21 can be referred to as a hydraulic head adapter. The adapter 21 is in the form of a sleeve connected to the turret 4. The adapter 21 comprises a mounting section 22 and a sealing section 23. The mounting section 22 comprises a collar 24 which is cylindrical and locates around the turret 4. An internal sidewall 25 of the collar 24 forms an interference fit with an external sidewall 26 of the turret 4. An upper portion of the external sidewall 26 comprises a first annular band 27 having an enlarged diameter for engaging the internal sidewall 25 of the collar 24 to form a first interference joint 28. A lower portion of the internal sidewall 25 comprises a second annular band 29 having a reduced diameter for engaging the external sidewall 26 of the turret 4 to form a second interference joint 30.

The sealing section 23 comprises a second bore 31 having the same diameter as the first bore 5. The first and second bores 5, 31 are disposed coaxially along the longitudinal axis X. The first and second bores 5, 31 thereby form a continuous pumping element bore 32 for receiving the pumping element 7. The pumping element 7 and the second bore 31 are sized to form a second seal 17. The second seal 17 is a metal-to-metal close clearance seal which is equivalent to the second seal 217 of the oil-lubricated pump P2 described herein. The second seal 17 is a low pressure seal and has a low pressure leakage control length L3. The second seal 17 reduces or inhibits leakage of oil past the pumping element. A third seal 18 in the form of a polytetrafluoroethylene (PTFE) lip seal is disposed below the second seal 17. The second seal 17 is a back-up for the third seal 18 to ensure that the oil does not mix with the fuel being pumped. It will be appreciated that the sealing section 23 can be modified depending on the sealing requirements of a particular application. Specific applications may, for example, have different dilution requirements and/or packaging requirements. The configuration of the second and third seals 17, 18 can be modified to meet the requirements of a particular application.

Figure 6:
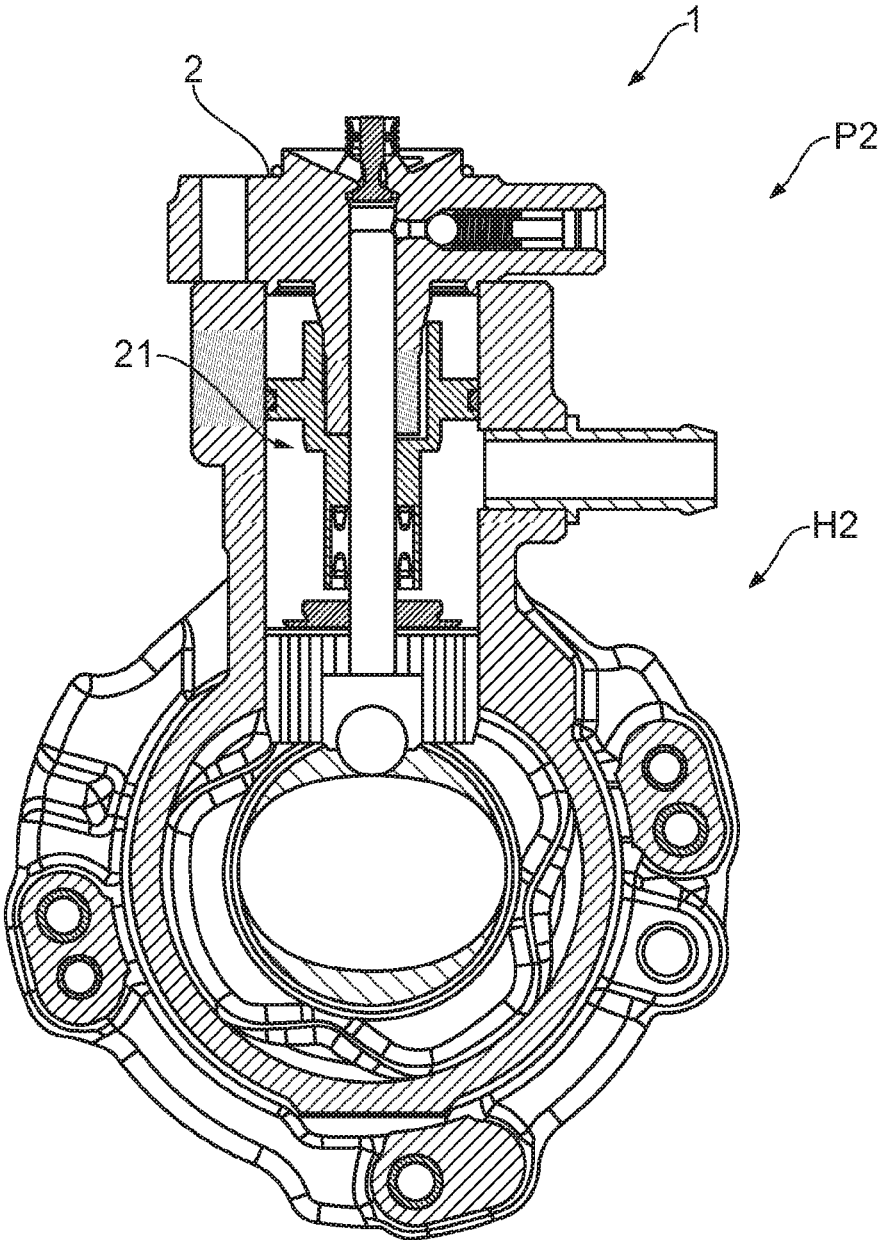
FIG. 6 shows the hydraulic head assembly shown in FIG. 5 used in combination with an oil-lubricated pump.

With reference to FIG. 6, the hydraulic head assembly 1 in accordance with the present invention is shown in use in an oil-lubricated pump P2. In the present embodiment, the hydraulic head 2 is disposed in a mounting aperture 33 formed in the pump housing H2. A collection chamber 35 is defined by the turret 4, the adapter 21 and the pump housing H2. In use, the collection chamber 35 collects any leakage between the turret 4 and the adapter 21 (represented by a dashed arrow in FIG. 5). The collection chamber 35 is sealed at its upper end by an interface between the pump housing H2 and a gasket face 36 formed on an underside of the body 3; and at its lower end by an interface between an O-ring 37 and the pump housing H2. The O-ring 37 is located in a locating channel 38 integrally formed with the mounting section 22 of the adapter 21. The fuel collected in the collection chamber 35 is returned to a tank (not shown) via a backleak return line (not shown).

The adapter 21 is fitted to the hydraulic head 2 after completion of the machining of the inlet valve seat 10. In order to accommodate the adapter 21, certain modifications are made to the hydraulic head 2 during the manufacturing process. In particular, the hydraulic head 2 requires additional hard stage operations to the external sidewall 26 of the turret 4 to permit the interference fit with the adapter 21. After the adaptor 21 has been fitted, a finishing operation is performed on an interior of the first and second bores 5, 31 to form a continuous pumping element bore in which the pumping element 7 reciprocates. This finishing operation helps to ensure that the required concentricity and bore geometries are maintained between the first and second bores 5, 31.

It will be appreciated that the adapter 21 in accordance with the present invention enables the same hydraulic head 2 to be used for both fuel- and oil-lubricated pumps. A second seal 17 can be incorporated into the adapter 21 to provide a low pressure back-up seal without compromising the machining capability of the inlet valve 8. Furthermore, the adapter 21 can be modified to fit various pump configurations. At least in certain embodiments, the hydraulic head assembly 1 of the present invention can have a reduced package size when compared to the oil-lubricated pump P2 described herein. A reduction in the height of the hydraulic head assembly 1 by approximately 20 mm (measured from a driveshaft axis to the top of the hydraulic head) is achievable.

Figure 7:
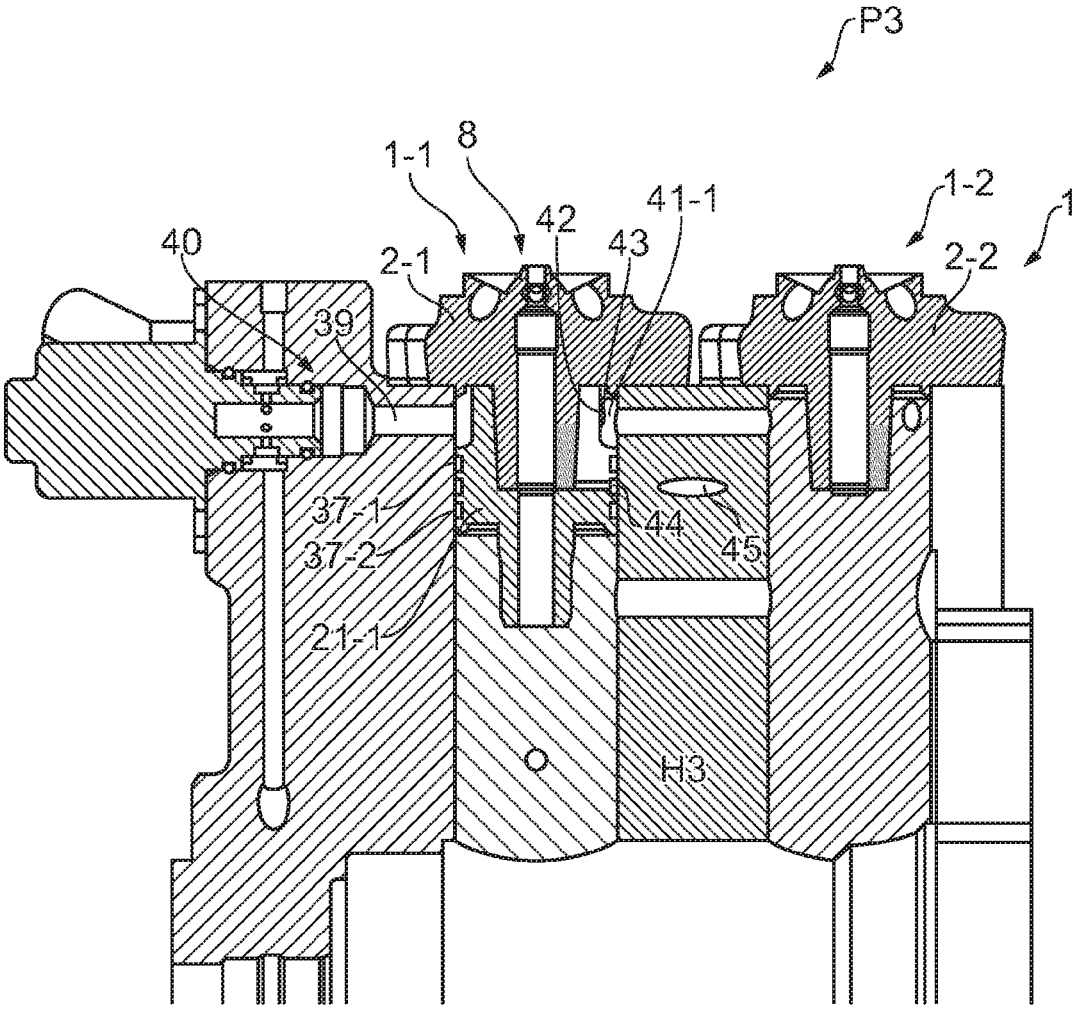
FIG. 7 shows a fuel pump comprising first and second hydraulic heads and adapters in accordance with an embodiment of the present invention.

The oil-lubricated pump P2 has a single pumping chamber 6. However, the adapter 21 described herein can be modified for an in-line oil-lubricated pump P3 comprising a plurality of pumping chambers 6. With reference to FIG. 7, the in-line oil-lubricated pump P3 comprises first and second hydraulic head assemblies 1-1, 1-2 disposed in a pump housing H3. The first and second hydraulic head assemblies 1-1, 1-2 have respective first and second hydraulic heads 2-1, 2-2 arranged in series. A first adapter 21-1 and a second adapter (not shown) are associated with the respective first and second hydraulic heads 2-1, 2-2. The first and second hydraulic heads 2-1, 2-2 and the first and second adapters 21-1, 21-2 are mounted in the pump housing H3. A supply line 39 formed in the pump housing H3 connects the first and second hydraulic heads 2-1, 2-2 to an inlet metering valve 40.

The first and second hydraulic heads 2-1, 2-2 define respective first and second pumping chambers 6-1, 6-2. The first and second hydraulic heads 2-1, 2-2 are a variant of the hydraulic head 2 described herein with reference to FIGS. 5 and 6 and like reference numerals are used for like components. Similarly, the first and second adapters 21-1, 21-2 are modified versions of the adapter 21 described herein and like reference numerals are again used for like components. The first and second adapters 21-1, 21-2 have the same configuration and only the first adapter 21-1 will be described for the sake of brevity.

The first adapter 21-1 forms a first fuel annulus 41-1 for receiving a metered supply of fuel from the inlet metering valve 40. An annular recess 42 formed in an outer sidewall of the first adapter 21-1 forms the first metered fuel annulus 41-1. The first fuel annulus 41-1 is connected to the inlet metering valve 40 by the supply line 39. A vertical bore 43 extending through the pump housing H3 and a bore (not shown) in the first hydraulic head 2-1 connects the first fuel annulus 41-1 with the inlet valve 8. A cross-drilling formed in the first adapter 21-1 opens at the interface between the first hydraulic head 2-1 and the first adapter 21-1 to form a backleak return line 44. A corresponding return line 45 formed in the pump housing H3 returns leakage fuel to a tank or reservoir. This arrangement seals the leaked high pressure fuel. A further modification of the first adapter 21-1 is to provide first and second O-rings 37-1, 37-2 for forming a seal between the adapter 21 and the pump housing H3.

It will be appreciated that various changes and modifications can be made to the hydraulic head assembly 1 and the adapter 21 described herein without departing from the scope of the present invention.

The invention claimed is:

1. A hydraulic head assembly comprising:

a hydraulic head having a first bore and a pumping chamber;

an adapter having a second bore, the adapter being connected to said hydraulic head such that said first and second bores form a substantially continuous pumping element bore; and a pumping element disposed within said pumping element bore for pressurising fuel in the pumping chamber;

wherein a first seal is formed between the pumping element and the hydraulic head; and a second seal is formed between the pumping element and the adapter, wherein the hydraulic head comprises a turret through which the first bore extends, the adapter being connected to said turret, wherein the adapter comprises a mounting section for mounting the adapter to the hydraulic head, wherein the mounting section comprises a collar for cooperating with the turret, wherein the collar is an interference fit with an external sidewall of the turret.

2. A hydraulic head assembly as claimed in claim 1, wherein the first seal is a high pressure seal; and the second seal is a low pressure seal.

3. A hydraulic head assembly as claimed in claim 1, wherein the adapter comprises a polymeric seal for cooperating with the pumping element.

4. A hydraulic head assembly as claimed in any claim 1, wherein a leakage path is formed between the turret and the adapter.

5. A hydraulic head assembly as claimed in claim 4 comprising a collection chamber in communication with the leakage path.

6. A hydraulic head assembly as claimed in claim 1, wherein the adapter comprises a backleak bore.

7. A hydraulic head assembly as claimed in claim 6, wherein the backleak bore extends transversely through the adapter.

8. A hydraulic head assembly as claimed in claim 1 comprising a plurality of said hydraulic heads and of said adapters.

9. A hydraulic head assembly as claimed in claim 8, wherein said hydraulic heads are said adapters are arranged in an in-line configuration.

10. A pump comprising:

a hydraulic head assembly having:

a hydraulic head having a first bore and a pumping chamber;

an adapter having a second bore, the adapter being connected to said hydraulic head such that said first and second bores form a substantially continuous pumping element bore; and a pumping element disposed within said pumping element bore for pressurising fuel in the pumping chamber;

wherein a first seal is formed between the pumping element and the hydraulic head; and a second seal is formed between the pumping element and the adapter, wherein the hydraulic head comprises a turret through which the first bore extends, the adapter being connected to said turret, wherein the adapter comprises a mounting section for mounting the adapter to the hydraulic head, wherein the mounting section comprises a collar for cooperating with the turret, wherein the collar is an interference fit with an external sidewall of the turret.

11. A hydraulic head assembly as claimed in claim 1, wherein the hydraulic head includes a body with which the turret is integrally formed and within which the pumping chamber is located.

12. A hydraulic head assembly as claimed in claim 11, wherein the interference fit retains the adaptor to the hydraulic head.

13. A hydraulic head assembly as claimed in claim 11, wherein the interference fit mounts the adaptor to the hydraulic head.

14. A hydraulic head assembly as claimed in claim 11, wherein an upper portion of the external sidewall comprises a first annular band having an enlarged diameter which engages an internal sidewall of the collar, thereby forming a first interference joint and wherein a lower portion of the internal sidewall comprises a second annular band having a reduced diameter which engages the external sidewall, thereby forming a second interference joint.

15. A hydraulic head assembly as claimed in claim 11, wherein the adaptor includes a locating channel on an outer periphery thereof which is configured to receive an O-ring therein such that the O-ring is captured axially between opposing surfaces of the locating channel, wherein the locating channel is not located within the hydraulic head.

16. A pump as claimed in claim 10, wherein the hydraulic head includes a body with which the turret is integrally formed and within which the pumping chamber is located.

17. A pump as claimed in claim 16, wherein the interference fit retains the adaptor to the hydraulic head.

18. A pump as claimed in claim 16, wherein the interference fit mounts the adaptor to the hydraulic head.

19. A pump as claimed in claim 16, wherein an upper portion of the external sidewall comprises a first annular band having an enlarged diameter which engages an internal sidewall of the collar, thereby forming a first interference joint and wherein a lower portion of the internal sidewall comprises a second annular band having a reduced diameter which engages the external sidewall, thereby forming a second interference joint.

20. A pump as claimed in claim 16, wherein the adaptor includes a locating channel on an outer periphery thereof which is configured to receive an O-ring therein such that the O-ring is captured axially between opposing surfaces of the locating channel, wherein the locating channel is not located within the hydraulic head.

* * * * *